US008189799B2

(12) United States Patent
Shridhar et al.

(10) Patent No.: US 8,189,799 B2
(45) Date of Patent: May 29, 2012

(54) SYSTEM FOR ACTIVE NOISE CONTROL BASED ON AUDIO SYSTEM OUTPUT

(75) Inventors: Vasant Shridhar, Royal Oak, MI (US); Duane Wertz, Byron, MI (US)

(73) Assignee: Harman International Industries, Incorporated, Northridge, CA (US)

( * ) Notice: Subject to any disclaimer, the term of this patent is extended or adjusted under 35 U.S.C. 154(b) by 405 days.

(21) Appl. No.: 12/421,459

(22) Filed: Apr. 9, 2009

(65) Prior Publication Data

US 2010/0260345 A1 Oct. 14, 2010

(51) Int. Cl.
*G10K 11/16* (2006.01)

(52) U.S. Cl. ..... 381/71.1

(58) Field of Classification Search ..... 381/71.1
See application file for complete search history.

(56) References Cited

U.S. PATENT DOCUMENTS

| | | | | |
|---|---|---|---|---|
| 4,589,137 | A | 5/1986 | Miller | 381/94 |
| 4,628,156 | A | 12/1986 | Irvin | 379/410 |
| 4,654,871 | A | 3/1987 | Chaplin et al. | 381/71 |
| 4,677,678 | A | 6/1987 | McCutchen | 381/72 |
| 4,910,799 | A | 3/1990 | Takayama | 455/296 |
| 4,941,187 | A | 7/1990 | Slater | 381/86 |
| 4,947,356 | A | 8/1990 | Elliott et al. | |
| 4,953,217 | A | 8/1990 | Twiney et al. | 381/72 |
| 4,977,600 | A | 12/1990 | Ziegler | 381/71 |
| 4,985,925 | A | 1/1991 | Langberg et al. | 381/72 |
| 4,998,241 | A | 3/1991 | Brox et al. | 370/32.1 |
| 5,001,763 | A | 3/1991 | Moseley | 381/71 |
| 5,033,082 | A | 7/1991 | Eriksson et al. | 379/410 |
| 5,091,954 | A | 2/1992 | Sasaki et al. | 381/72 |
| 5,105,377 | A | 4/1992 | Ziegler, Jr. | 364/724.01 |
| 5,133,017 | A | 7/1992 | Cain et al. | 381/71 |
| 5,138,664 | A | 8/1992 | Kimura et al. | 381/72 |
| 5,170,433 | A | 12/1992 | Elliott et al. | |

(Continued)

FOREIGN PATENT DOCUMENTS

CN 1688179 A 10/2005

(Continued)

OTHER PUBLICATIONS

Gao, F. X. Y. et al., "An Adaptive Backpropagation Cascade IIR Filter," *IEEE*, vol. 39, No. 9, 1992, pp. 606-610.

(Continued)

*Primary Examiner* — Elvin G Enad
*Assistant Examiner* — Robert W Horn
(74) *Attorney, Agent, or Firm* — Brinks Hofer Gilson & Lione

(57) ABSTRACT

An active noise control (ANC) system is configured to generate at least one anti-noise signal configured to drive a speaker to generate sound waves to destructively interfere with an undesired sound present in a target space. The at least one anti-noise signal is adjusted based an output signal of an audio system. The at least one anti-noise signal may be adjusted based on at least one of a volume level of the audio system, a power level of at least one predetermined frequency or frequency range of the output signal of the audio system, frequency content of an output signal of the audio system. The ANC system receives an error signal to adjust generation of the at least one anti-noise signal. The error signal is adjusted to compensate for adjustment of the at least one anti-noise signal based on the output signal of the audio system.

37 Claims, 8 Drawing Sheets

U.S. PATENT DOCUMENTS 5,182,774 A 1/1993 Bourk ..... 381/71
5,208,868 A 5/1993 Sapiejewski ..... 381/183
5,251,262 A 10/1993 Suzuki et al. ..... 381/71
5,276,740 A 1/1994 Inanaga et al. ..... 381/187
5,289,147 A 2/1994 Koike et al. ..... 355/200
5,305,387 A 4/1994 Sapiejewski ..... 381/71
5,321,759 A 6/1994 Yuan ..... 381/71.9
5,337,366 A 8/1994 Eguchi et al. ..... 381/71
5,371,802 A 12/1994 McDonald et al.
5,377,276 A 12/1994 Terai et al. ..... 381/71
5,381,473 A 1/1995 Andrea et al. ..... 379/387
5,381,485 A 1/1995 Elliott
5,400,409 A 3/1995 Linhard ..... 381/92
5,427,102 A 6/1995 Shimode et al. ..... 128/653.2
5,485,523 A 1/1996 Tamamura et al. ..... 381/71
5,492,129 A 2/1996 Greenberger ..... 128/715
5,493,616 A 2/1996 Iidaka et al. ..... 381/71
5,497,426 A 3/1996 Jay ..... 381/67
5,499,302 A 3/1996 Nagami et al. ..... 381/71
5,526,421 A 6/1996 Berger et al. ..... 379/389
5,559,893 A 9/1996 Krokstad et al. ..... 381/71
5,586,189 A 12/1996 Allie et al. ..... 381/71
5,602,927 A 2/1997 Tamamura et al. ..... 381/71
5,602,928 A 2/1997 Eriksson et al. ..... 381/71
5,604,813 A 2/1997 Evans et al. ..... 381/71
5,621,803 A 4/1997 Laak ..... 381/71
5,673,325 A 9/1997 Andrea et al. ..... 381/92
5,675,658 A 10/1997 Brittain ..... 381/72
5,680,337 A 10/1997 Pedersen et al. ..... 364/724.19
5,687,075 A 11/1997 Stothers
5,691,893 A 11/1997 Stothers
5,692,059 A 11/1997 Kruger ..... 381/151
5,699,437 A 12/1997 Finn
5,706,344 A 1/1998 Finn ..... 379/410
5,715,320 A 2/1998 Allie et al. ..... 381/71.12
5,727,066 A 3/1998 Elliott et al.
5,737,433 A 4/1998 Gardner ..... 381/94.7
5,740,257 A 4/1998 Marcus ..... 381/71.6
5,745,396 A 4/1998 Shanbhag ..... 364/724.19
5,768,124 A 6/1998 Stothers et al.
5,774,564 A 6/1998 Eguchi et al. ..... 381/71.11
5,774,565 A 6/1998 Benning et al. ..... 381/83
5,809,156 A 9/1998 Bartels et al. ..... 381/183
5,815,582 A 9/1998 Claybaugh et al. ..... 381/71.6
5,872,728 A 2/1999 Richter ..... 364/724.2
5,937,070 A 8/1999 Todter et al. ..... 381/71.6
6,069,959 A 5/2000 Jones ..... 381/71.6
6,078,672 A 6/2000 Saunders et al. ..... 381/71.6
6,163,610 A 12/2000 Bartlett et al. ..... 379/433
6,166,573 A 12/2000 Moore et al. ..... 327/161
6,181,801 B1 1/2001 Puthuff et al. ..... 381/380
6,185,299 B1 2/2001 Goldin ..... 379/406
6,278,785 B1 8/2001 Thomasson ..... 381/66
6,295,364 B1 9/2001 Finn et al. ..... 381/110
6,301,364 B1 10/2001 Lowmiller et al. ..... 381/66
6,343,127 B1 1/2002 Billoud ..... 381/71.4
6,347,146 B1 2/2002 Short et al. ..... 381/15
6,377,680 B1 4/2002 Foladare et al. ..... 379/392.01
6,421,443 B1 7/2002 Moore et al. ..... 379/406.01
6,445,799 B1 9/2002 Taenzer et al. ..... 381/71.6
6,445,805 B1 9/2002 Grugel ..... 381/330
6,466,673 B1 10/2002 Hardy
6,496,581 B1 12/2002 Finn et al. ..... 379/406.01
6,505,057 B1 1/2003 Finn et al. ..... 455/569
6,529,605 B1 * 3/2003 Christoph ..... 381/56
6,532,289 B1 3/2003 Magid ..... 379/406.01
6,532,296 B1 3/2003 Vaudrey et al. ..... 381/371
6,567,524 B1 5/2003 Svean et al. ..... 381/71.1
6,567,525 B1 5/2003 Sapiejewski ..... 381/71.6
6,597,792 B1 7/2003 Sapiejewski et al. ..... 381/71.6
6,625,286 B1 9/2003 Rubacha et al. ..... 381/93
6,633,894 B1 10/2003 Cole ..... 708/300
6,643,619 B1 11/2003 Linhard et al. ..... 704/233
6,665,410 B1 12/2003 Parkins ..... 381/71.1
6,687,669 B1 2/2004 Schrogmeier et al. ..... 704/226
6,690,800 B2 2/2004 Resnick ..... 381/73.1
6,798,881 B2 9/2004 Thomasson ..... 379/406.07
6,845,162 B1 1/2005 Emborg et al. ..... 381/71.4
6,991,289 B2 1/2006 House ..... 297/217.4
7,020,288 B1 3/2006 Ohashi ..... 381/71.4
7,062,049 B1 6/2006 Inoue et al. ..... 381/71.4
7,103,188 B1 * 9/2006 Jones ..... 381/71.9
7,133,529 B2 * 11/2006 Ura ..... 381/66
7,333,618 B2 * 2/2008 Shuttleworth et al. ..... 381/57
7,440,578 B2 10/2008 Arai et al. ..... 381/302
7,469,051 B2 * 12/2008 Sapashe et al. ..... 381/104
7,574,006 B2 8/2009 Funayama et al. ..... 381/71.12
7,627,352 B2 12/2009 Gauger, Jr. et al. ..... 455/569.1
7,630,432 B2 12/2009 Hofmeister ..... 375/232
7,773,760 B2 8/2010 Sakamoto et al. ..... 381/71.9
7,808,395 B2 10/2010 Raisenan et al. ..... 340/667
7,873,173 B2 1/2011 Inoue et al. ..... 381/71.4
7,885,417 B2 2/2011 Christoph ..... 381/71.11
7,933,420 B2 * 4/2011 Copley et al. ..... 381/71.11
8,027,484 B2 9/2011 Yoshida et al. ..... 381/71.4
2001/0036283 A1 11/2001 Donaldson ..... 381/71.11
2002/0068617 A1 6/2002 Han
2002/0076059 A1 6/2002 Joynes ..... 381/71.6
2002/0138263 A1 9/2002 Deligne et al. ..... 704/233
2002/0143528 A1 10/2002 Deligne et al. ..... 704/224
2002/0172374 A1 11/2002 Bizjak ..... 381/71.14
2002/0176589 A1 11/2002 Buck et al. ..... 381/94.7
2003/0035551 A1 2/2003 Light et al. ..... 381/71.6
2003/0103636 A1 6/2003 Arai et al. ..... 381/302
2003/0142841 A1 7/2003 Wiegand ..... 381/172
2003/0228019 A1 * 12/2003 Eichler et al. ..... 381/71.8
2004/0037429 A1 2/2004 Candioty ..... 381/67
2004/0076302 A1 * 4/2004 Christoph ..... 381/57
2005/0175187 A1 8/2005 Wright et al. ..... 381/71.12
2005/0207585 A1 9/2005 Christoph ..... 381/71.11
2005/0226434 A1 10/2005 Franz et al. ..... 381/71.7
2005/0232435 A1 10/2005 Stothers et al.
2006/0098809 A1 5/2006 Nongpiur et al. ..... 379/406.14
2006/0153394 A1 * 7/2006 Beasley ..... 381/57
2006/0251266 A1 * 11/2006 Saunders et al. ..... 381/71.1
2006/0262935 A1 11/2006 Goose et al. ..... 381/17
2007/0053532 A1 3/2007 Elliott et al.
2007/0098119 A1 5/2007 Stothers et al.
2007/0253567 A1 11/2007 Sapiejewski ..... 381/71.6
2007/0274531 A1 * 11/2007 Camp ..... 381/74
2008/0095383 A1 4/2008 Pan et al. ..... 381/71.11
2008/0181422 A1 * 7/2008 Christoph ..... 381/73.1
2008/0192948 A1 8/2008 Kan et al. ..... 381/71.4
2008/0247560 A1 * 10/2008 Fukuda et al. ..... 381/71.6
2009/0067638 A1 3/2009 Sakamoto et al. ..... 381/71.4
2009/0086990 A1 4/2009 Christoph ..... 381/71.12
2009/0086995 A1 4/2009 Christoph et al.
2009/0220102 A1 9/2009 Pan et al. ..... 381/71.11
2010/0014685 A1 1/2010 Wurm ..... 381/71.11
2010/0061566 A1 * 3/2010 Moon et al. ..... 381/71.8
2010/0098263 A1 4/2010 Pan et al. ..... 381/71.11
2010/0098265 A1 4/2010 Pan et al. ..... 381/94.1
2010/0124336 A1 5/2010 Shridhar et al. ..... 371/71.4
2010/0124337 A1 5/2010 Wertz et al. ..... 381/71.11
2010/0177905 A1 7/2010 Shridhar et al. ..... 381/71.11
2010/0226505 A1 * 9/2010 Kimura ..... 381/71.6
2010/0239105 A1 9/2010 Pan ..... 381/94.9
2010/0260345 A1 * 10/2010 Shridhar et al. ..... 381/71.1
2010/0266134 A1 10/2010 Wertz et al. ..... 381/71.1
2010/0266137 A1 * 10/2010 Sibbald et al. ..... 381/71.6
2010/0272275 A1 10/2010 Carreras et al. ..... 381/71.6
2010/0272276 A1 * 10/2010 Carreras et al. ..... 381/71.6
2010/0272280 A1 10/2010 Joho et al. ..... 381/71.6
2010/0272281 A1 10/2010 Carreras et al. ..... 381/71.6
2010/0274564 A1 10/2010 Bakalos et al. ..... 704/500
2010/0290635 A1 11/2010 Shridhar et al. ..... 381/71.1
2010/0296669 A1 * 11/2010 Oh et al. ..... 381/109
2011/0116643 A1 * 5/2011 Tiscareno et al. ..... 381/58

FOREIGN PATENT DOCUMENTS

EP 0 622 779 A2 11/1994
EP 0 539 940 B1 4/1996
EP 0 572 492 B1 11/1997
EP 1 577 879 B1 7/2008
EP 1 947 642 A1 7/2008
GB 2 293 898 B 4/1996
JP 61-112496 5/1986

| | | | |
|---|---|---|---|
| JP | 06-318085 | | 11/1994 |
| JP | 06-332474 | | 12/1994 |
| JP | 08-095579 | | 4/1996 |
| JP | 08-234767 | | 9/1996 |
| JP | 10-207470 | | 8/1998 |
| JP | 11 259078 | A | 9/1999 |
| JP | 2007-253799 | | 10/2007 |
| WO | WO 90/09655 | | 8/1990 |
| WO | WO 94/09480 | | 4/1994 |
| WO | WO 94/09481 | | 4/1994 |
| WO | WO 94/09482 | | 4/1994 |
| WO | WO 95/26521 | | 10/1995 |
| WO | WO 96/10780 | | 4/1996 |

OTHER PUBLICATIONS

Kuo, S. M. et al., "Active Noise Control Systems: Algorithms and DSP Implementations," John Wiley & Sons, Inc., New York, NY, Copyright 1996, pp. 88-97.

Extended European Search Report from European Application No. EP 10150426.4-2213, dated May 26, 2010, 7 pgs.

Martins C R et al., "Fast Adaptive Noise Canceller Using the LMS Algorithm", Proceedings of the International Conference on Signal Processing Applications and Technology, vol. 1, Sep. 28, 1993, 8 pgs.

European Search Report from European Application No. EP 10162225, dated Oct. 1, 2010, 5 pgs.

Gonzalez, A. et al., "Minimisation of the maximum error signal in active control", IEEE International Conference on Acoustics, Speech, and Signal Processing, 1997, 4 pgs.

Kuo, S. M. et al., "Active Noise Control Systems: Algorithms and DSP Implementations," John Wiley & Sons, Inc., New York, NY, Copyright 1996, 419 pgs.

Colin H. Hansen et al., "Active Control of Noise and Vibration," E & FN Spon., London SE1, Copyright 1997, pp. 642-652.

Office Action, dated Jul. 25, 2011, pp. 1-11, U.S. Appl. No. 12/275,118, U.S. Patent and Trademark Office, Virginia.

Office Action, dated Aug. 3, 2011, pp. 1-33, U.S. Appl. No. 12/352,435, U.S. Patent and Trademark Office, Virginia.

Office Action, dated Aug. 17, 2011, pp. 1-26, U.S. Appl. No. 12/425,997, U.S. Patent and Trademark Office, Virginia.

Office Action, dated Sep. 13, 2011, pp. 1-16, U.S. Appl. No. 12/420,658, U.S. Patent and Trademark Office, Virginia.

Notice of Allowance, dated Aug. 15, 2011, pp. 1-14, U.S. Appl. No. 12/466,282, U.S. Patent and Trademark Office, Virginia.

Chinese Office Action, dated Aug. 9, 2011, pp. 1-8, Chinese Patent Application No. 2010101643433, Chinese Patent Office, China.

Chen, Kean et al., Adaptive Active Noise Elimination and Filter-XLMS Algorithm, 1993, pp. 27-33, vol. 12 (4), Applied Acoustics, and translation of Abstract (8 pgs.).

Notice of Allowance, dated Nov. 2, 2011, pp. 1-9, U.S. Appl. No. 12/275,118, U.S. Patent and Trademark Office, Virginia.

Japanese Office Action, dated Jan. 4, 2012, pp. 1-6, Japanese Patent Application No. 2010-086595, Japanese Patent Office, Japan.

Office Action, dated Feb. 14, 2012, pp. 1-36, U.S. Appl. No. 12/352,435, U.S. Patent and Trademark Office, Virginia.

Notice of Allowance, dated Jan. 13, 2012, U.S. Appl. No. 12/425,997, U.S. Patent and Trademark Office, Virginia.

Office Action, dated Mar. 7, 2012, pp. 1-13, U.S. Appl. No. 12/420,658, U.S. Patent and Trademark Office, Virginia.

* cited by examiner

SYSTEM FOR ACTIVE NOISE CONTROL BASED ON AUDIO SYSTEM OUTPUT

BACKGROUND OF THE INVENTION

1. Technical Field

This invention relates to active noise control, and more specifically to active noise control used with an audio system.

2. Related Art

Active noise control may be used to generate sound waves that destructively interfere with a targeted sound. The destructively interfering sound waves may be produced through a loudspeaker to combine with the targeted sound. Active noise control may be desired in a situation in which audio sound waves, such as music, may be desired as well. An audio/visual system may include various loudspeakers to generate audio. These loudspeakers may be used simultaneously to produce destructively interfering sound waves.

Destructively-interfering sound waves may be generated by an ANC system operating through an amplifier being used by an audio/visual system. Sound waves based on the audio/video system output may be loud enough to mask the targeted sound from being heard by a listener. While destructively-interfering waves may be combining with a targeted sound, at least a portion of the targeted sound may not have been heard by a listener due to audio-based sound waves. Thus, at least a portion of the destructively-interfering sound waves may not be required since the undesired sound is already inaudible to the listener due to the masking. The amplitude or frequency content of the destructively-interfering sound waves may be adjusted to allow more power from the amplifier to be dedicated to the audio/video system. Therefore, a need exists to adjust destructively interfering sound waves generated by an active noise control system based on audio/visual system output.

SUMMARY

An active noise control (ANC) system may generate at least one anti-noise signal to drive one or more respective speakers. The speakers may be driven to generate sound waves to destructively interfere with undesired sound present in at least one targeted listening space. The ANC system may generate the anti-noise signals based on at least one input signal representative of the undesired sound. At least one microphone may detect sound waves resulting from the combination of the generated sound waves and the undesired sound. The microphone may generate an error signal based on detection of the combined generated sound waves and the undesired sound waves. The ANC system may receive the error signal and adjust the anti-noise signal based on the error signal.

The ANC system may be configured to adjust at least one anti-noise signal based on output from an audio system. The ANC system may adjust the at least one anti-noise signal based on a volume setting of the audio system. The ANC system may reduce the amplitude of the at least one anti-noise signal based on a predetermined volume threshold. The error signal may be adjusted to compensate for the adjustment of the anti-noise based on the output from the audio system.

The ANC system may be configured to adjust the at least one anti-noise signal based on a power level of an output signal of the audio system. An audio system output signal may be filtered to isolate at least one predetermined frequency or frequency range. The power level associated with the at least one predetermined frequency or frequency range may be determined. The ANC system may adjust the anti-noise signal based on the determined power level. The error signal may be adjusted to compensate for the adjustment of the at least one anti-noise signal based on the determined power level.

The ANC system may be configured to adjust the at least one anti-noise signal based on the frequency content of an output signal of the audio system. The output signal may be analyzed to determine at least one frequency or frequency range present in the output signal of the audio system. The ANC system may be configured to filter the at least one input signal based on the at least one frequency or frequency range present in the output signal of the audio system. The ANC system may adjust the at least one anti-noise signal based on the filtered input signal. The error signal may be adjusted to compensate for the adjustment of the anti-noise signal based on the filtered input signal.

Other systems, methods, features and advantages of the invention will be, or will become, apparent to one with skill in the art upon examination of the following figures and detailed description. It is intended that all such additional systems, methods, features and advantages be included within this description, be within the scope of the invention, and be protected by the following claims.

BRIEF DESCRIPTION OF THE DRAWINGS

The system may be better understood with reference to the following drawings and description. The components in the figures are not necessarily to scale, emphasis instead being placed upon illustrating the principles of the invention. Moreover, in the figures, like referenced numerals designate corresponding parts throughout the different views.

DETAILED DESCRIPTION OF THE PREFERRED EMBODIMENTS

The present disclosure provides a system configured to generate a destructively interfering sound wave and adjust the sound wave based on audio system output. This is accomplished generally by first determining the presence of an undesired sound and generating a destructively interfering sound wave into a target space in which the undesired sound is present. An audio system may also be providing audio output used to generate audio sound waves into the target space. The destructively interfering sound wave may be adjusted based on various conditions associated with the audio output.

Figure 1:
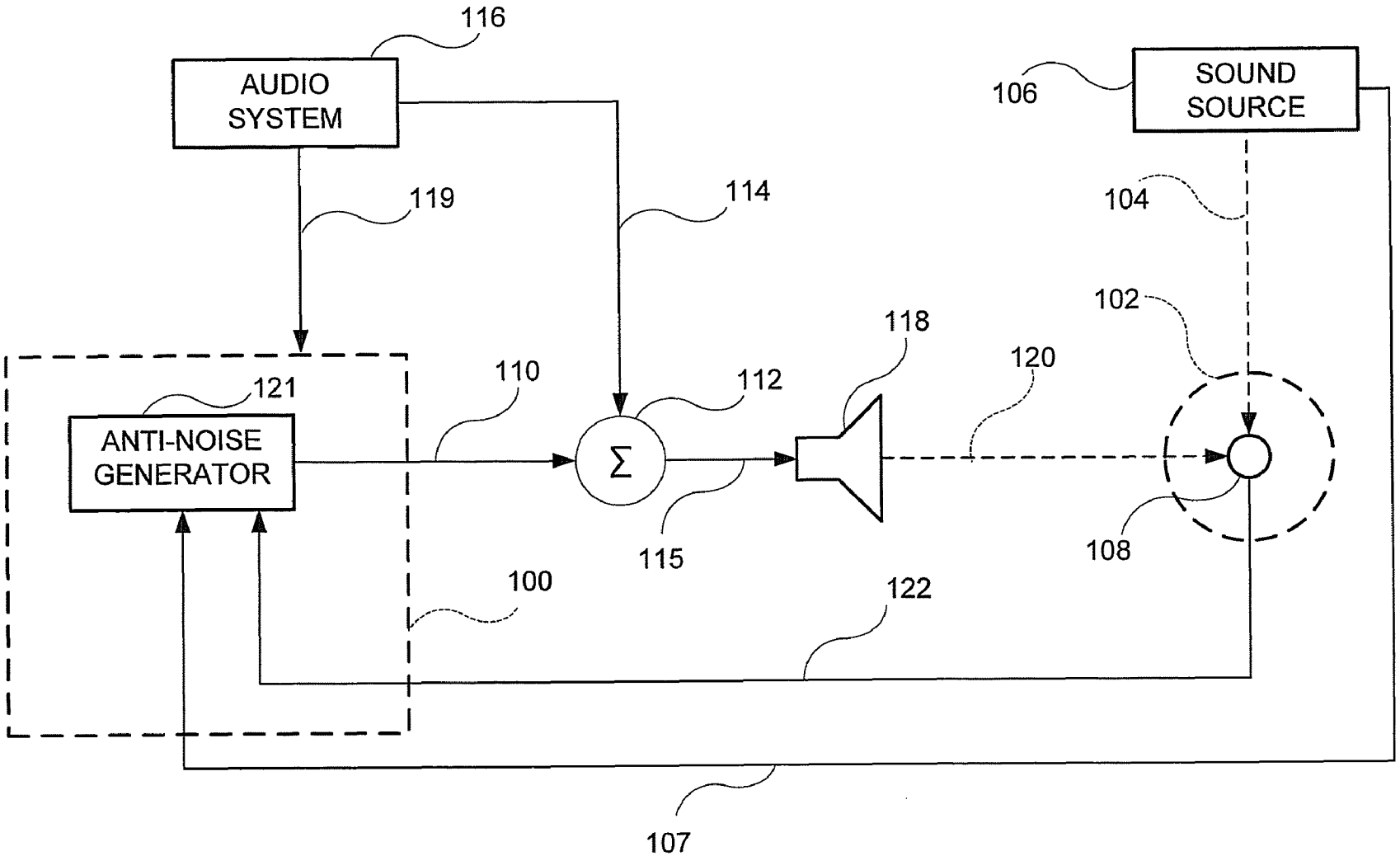
FIG. 1 is a diagrammatic view of an example active noise cancellation (ANC) system.

In FIG. 1, an example of an active noise control (ANC) system 100 is diagrammatically shown. The ANC system 100 may be implemented in various settings, such as a vehicle interior, to reduce or eliminate particular sound frequencies or frequency ranges from being audible by a listener in a target space 102. The example ANC system 100 of FIG. 1 is configured to generate signals at one or more desired frequencies or frequency ranges that may be generated as sound waves to destructively interfere with undesired sound 104, represented by a dashed-arrow in FIG. 1, originating from a sound source 106. In one example, the ANC system 100 may be configured to destructively interfere with an undesired sound 104 within a frequency range of approximately 20-500 Hz. The ANC system 100 may receive a reference signal 107 indicative of sound emanating from the sound source 106 that is audible in the target space 102.

A sensor such as a microphone 108 may be placed in the target space 102. The ANC system 100 may generate an anti-noise signal 110, which in one example may be representative of sound waves of approximately equal amplitude and frequency that are approximately 180 degrees out of phase with the undesired sound 104 present in the target space 102. The 180 degree phase shift of the anti-noise signal 110 may cause desirable destructive interference with the undesired sound in an area in which the anti-noise sound waves and the undesired sound 104 sound waves destructively combine.

In FIG. 1, the anti-noise signal 110 is shown as being summed at summation operation 112 with an audio signal 114, generated by an audio system 116 to form an output signal 115. The output signal 115 is provided to drive a speaker 118 to produce a speaker output 120. The speaker output 120 may be an audible sound wave that projected towards the microphone 108 within the target space 102. The anti-noise signal 110 component of the sound wave produced as the speaker output 120 may destructively interfere with the undesired sound 104 within the target space 102. In alternative examples, the audio signal 114 and the anti-noise signal 110 may each drive separate speakers to produce sound waves projected into the target space 102.

The microphone 108 may generate a microphone output signal 122 based on detection of the combination of the speaker output 120 and the undesired noise 104, as well as other audible signals within range of being received by the microphone 108. The microphone output signal 122 may be used as an error signal in order to adjust the anti-noise signal 110.

In one example, the audio system 116 may be generating the audio output signal 114 that may result in driving the speakers, such as the speaker 118, to produce loud enough speaker output within the target space 102 that the undesired sound may be masked, either partially or totally from being audible to a listener. When the audio-based speaker output results in at least partial masking of the undesired sound 104 in the target space 102, it may be desirable to reduce at least some anti-noise. Due to the masking by the audio system 116, reducing at least some of the anti-noise being produced may be desired because the ANC system 100 may share a common amplifier with the audio system 116. Reduction of unnecessary anti-noise being produced may allow more power from the amplifier to be dedicated to the audio system 116 and may also result in less overall power consumption. In one example, generation of the anti-noise may be adjusted based on the output of the audio system 116. The ANC system 100 may receive a signal 119 indicative of the output of the audio system 116. The anti-noise system 100 may use the signal 119 to adjust the anti-noise signal 110 generated by an anti-noise generator 121. For example, the signal 119 may indicate a volume setting on the audio system 116, such as described in FIG. 3. The ANC system 100 may be configured to reduce or halt generation of anti-noise when the volume reaches some predetermined threshold. Thus, less anti-noise may be produced once the volume setting of the audio system 116 is set at a predetermined volume level regardless of the presence of the undesired sound in the target space 102. In alternative examples, the signal 119 may indicate other conditions of the audio system 116 such as power level of output signal components within particular frequency ranges.

Figure 2:
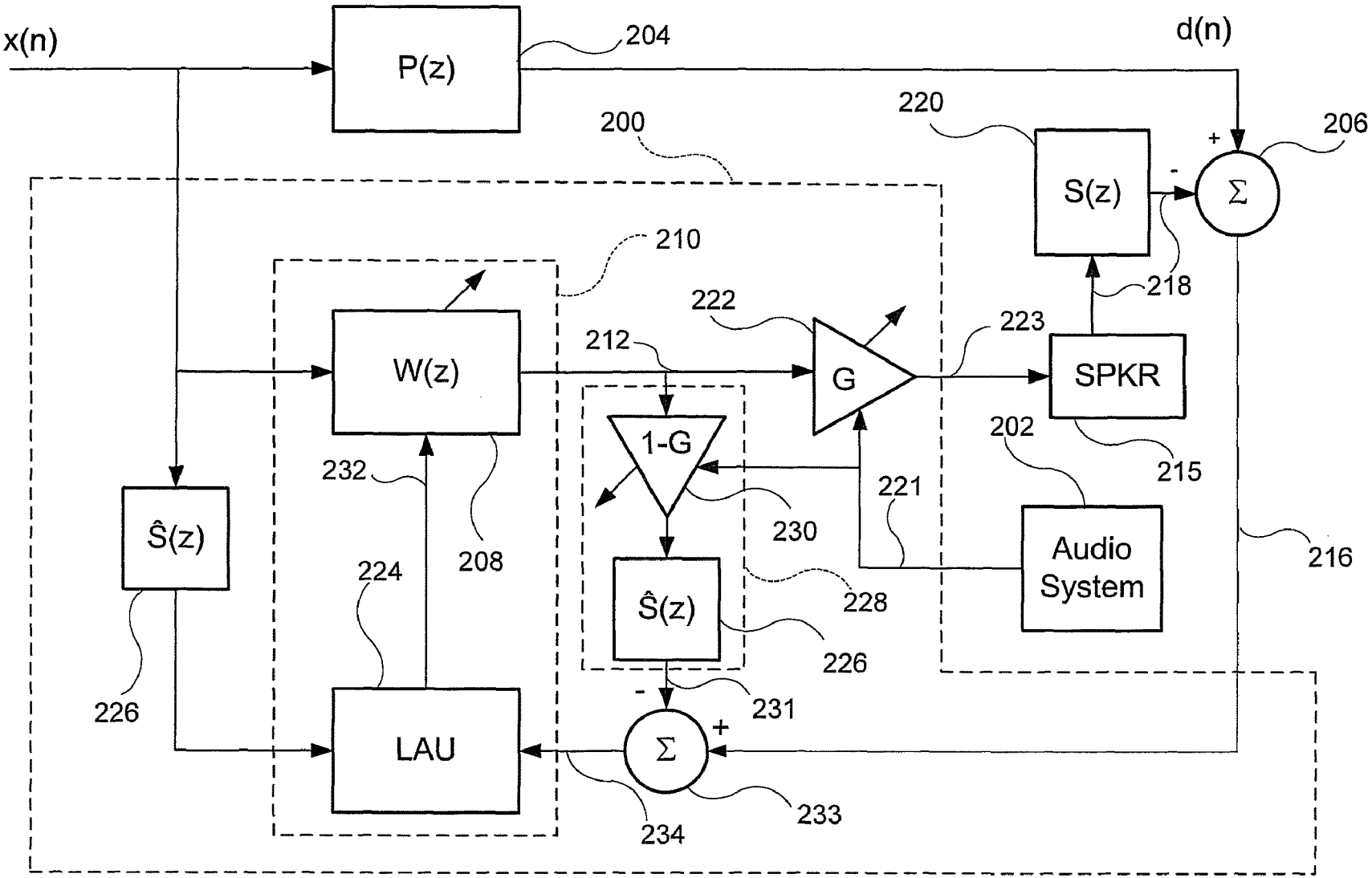
FIG. 2 is a block diagram of an example configuration implementing an ANC system.

In FIG. 2, an example ANC system 200 and an example physical environment are represented through a block diagram format. The ANC system 200 may operate in a manner similar to the ANC system 100 as described with regard to FIG. 1. In one example, an undesired sound x(n) may traverse a physical path 204 from a source of the undesired sound x(n) to a microphone 206. The physical path 204 may be represented by a Z-domain transfer function P(z). The undesired sound x(n) at the microphone 206 may be represented as d(n). In FIG. 2, the undesired sounds x(n) and d(n) represent the undesired sound both physically and as a digital representation that may be produced through use of an analog-to-digital (A/D) converter. The undesired sound x(n) may also be used as an input to an adaptive filter 208, which may be included in an anti-noise generator 210. The adaptive filter 208 may be represented by a Z-domain transfer function W(z). The adaptive filter 208 may be a digital filter configured to be dynamically adapted in order to filter an input signal to produce a desired anti-noise signal 212 as an output signal. In FIG. 2, the adaptive filter 208 receives the undesired sound x(n) as an input signal.

Similar to that described in FIG. 1, the anti-noise signal 212 may be used to drive a speaker 215. The anti-noise signal 212 may drive the speaker 215 to produce a sound wave. The output of the speaker 215 is represented as speaker output 218 in FIG. 2. The speaker output 218 may be a sound wave that travels a physical path 220 that includes a path from the speaker 215 to the microphone 206. The physical path 220 may be represented in FIG. 2 by a Z-domain transfer function S(z). The speaker output 218 and the undesired noise x(n) may be received by the microphone 206 and a microphone output signal 216 may be generated by the microphone 206. Similar to FIG. 1, the microphone output signal 216 may serve as an error signal. In other examples, any number of speaker and microphones may be present.

As similarly discussed with regard to FIG. 1, the anti-noise signal 212 may be adjusted based on the output of the audio system 202. In FIG. 2, an audio output signal 221 is shown as being provided by the audio system 202 to the ANC system 200. In FIG. 2, the audio output signal 221 may represent various signals that may be provided by the audio system 202 indicating a particular condition of the audio system 202, such as the volume or output signal power. The ANC system 200 may use the audio output signal 221 to adjust the anti-noise signal 212 regardless of the condition of the undesired sound d(n). The audio system 202 may also generate an audio output signal (not shown) used to drive a speaker, such as the speaker 215, to produce audio-based sound waves.

The ANC system 200 may include an anti-noise compensator 222, represented in FIG. 2 as an adjustable gain amplifier having a gain of "G." The anti-noise compensator 222 may adjust the anti-noise signal 212 based on the audio output signal 221 to produce an adjusted anti-noise signal 223. In one example, the compensator 222 may serve as an "on/off"

switch to the ANC system 200. For example, the compensator 222 may be configured such that, based on the audio output signal 221, the compensator 222 gain is either one or zero. Thus, if the audio output signal 221 represented a volume level of the audio system 202, the compensator 222 may have a gain of one until a certain volume threshold of the audio system 202 is reached. While the gain is one, the adjusted anti-noise signal 223 includes the entire anti-noise signal 212. At the threshold, the gain of the compensator 222 would become zero and none of the anti-noise signal 212 would be provided to the speaker 215.

In another example, the gain of the compensator 222 may be adjusted to gain values between zero and one based on the audio output signal 221. Adjustment of the gain varies the adjusted anti-noise signal 223. In one example, the audio signal 221 may represent a power level of output from the audio system 202 associated with a particular frequency range. As the power level associated with the particular frequency range component of the audio output signal increases, the gain of the compensator 222 may be reduced. The reduction may occur because the audio system 202 may be generating output signals resulting in sound waves within the same frequency range as the undesired sound d(n). Thus, the sound waves based on output from the audio system 202 may mask some of the undesired sound d(n) perceived by a listener resulting in less anti-noise being desired to reduce or eliminate the undesired sound d(n).

The microphone output signal 216 may be transmitted to a learning algorithm unit (LAU) 224, which may be included in the anti-noise generator 210. The LAU 224 may implement various learning algorithms, such as least mean squares (LMS), recursive least mean squares (RLMS), normalized least mean squares (NLMS), or any other suitable learning algorithm. The LAU 224 also receives as an input the undesired noise x(n) filtered by an estimated path filter 226, which provides an estimated effect on the undesired sound x(n) traversing the physical path 220. In FIG. 2, the estimated path filter 226 may be represented as a Z-domain transfer function $\hat{S}(z)$. LAU output 232 may be an update signal transmitted from the LAU 224 to the adaptive filter 208. Thus, the adaptive filter 208 generates the anti-noise signal 223 based on the undesired noise x(n) and the LAU output 232. The LAU output 232 is transmitted to the adaptive filter 208 to allow the adaptive filter 208 to adjust anti-noise generation based on the microphone output signal 216.

When the compensator 222 has a gain of less than one, the microphone output signal 216 may be adjusted in order to compensate for anti-noise adjustment performed by the compensator 222. An error compensator 228 may be used to generate an error compensation signal 231. When the compensator 222 is used to adjust the anti-noise signal 212, the compensated anti-noise signal 223 may be less than the anti-noise signal 212. Thus, the speaker 215 may be driven to produce a sound wave containing anti-noise lower than that would be produced based on the anti-noise signal 212. The microphone output signal 216 would transmit an inaccurate error signal back to the LAU 224 because the LAU 224 would be receiving an error signal based on the compensated anti-noise signal 223 instead of the anti-noise signal 212. The adaptive filter 208 would be receiving the LAU output 223, which would not indicate error resulting from the anti-noise signal 212 driving the speaker 215.

The error compensator 228 includes a gain operator 230, which may be an adjustable gain amplifier, and an estimated path filter 226. The gain of the gain operator 230 is "1-G," where G is the gain of the compensator 222. The output of the gain operator 230 is input into the filter 226 to produce an error compensation signal 231. The error compensation signal 231 is subtracted from the microphone output signal 216 at operator 233 to remove error due to compensation of the anti-noise signal 212 by the compensator 222. The output of the operator 233 is a compensated error signal 234 provided to the LAU 224.

Figure 3:
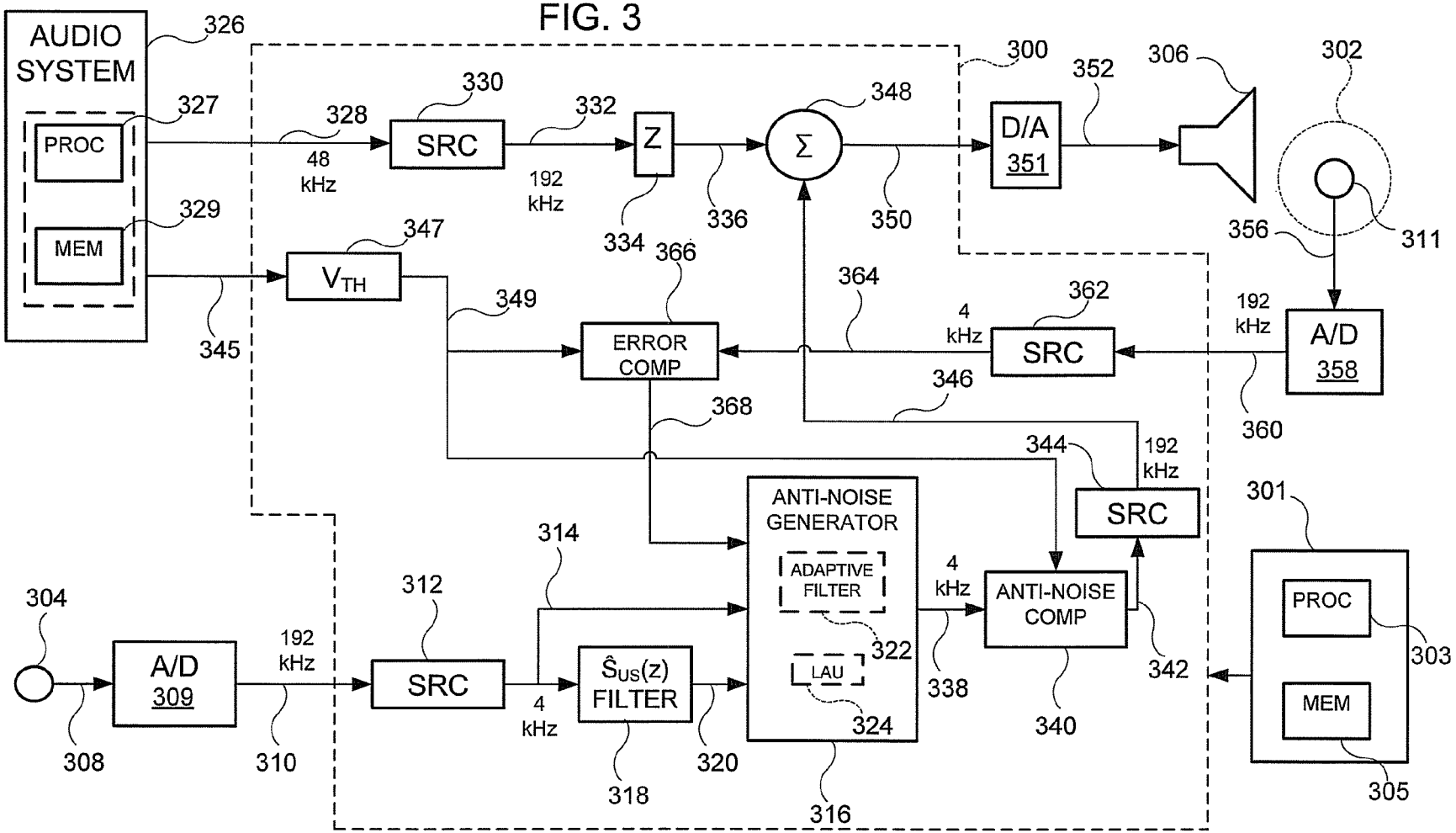
FIG. 3 is an example ANC system configured to adjust anti-noise generation based on a volume setting of an audio system.

FIG. 3 shows an ANC system 300 configured to generate anti-noise and adjust anti-noise based on audio system output. In one example, the ANC system 300 may be generated by a computer device 301. The computer device 301 may include a processor 303 and a memory 305. The memory 305 may be computer-readable storage media or memories, such as a cache, buffer, RAM, removable media, hard drive or other computer readable storage media. Computer readable storage media include various types of volatile and nonvolatile storage media. Various processing techniques may be implemented by the processor 303 such as multiprocessing, multitasking, parallel processing and the like, for example.

In FIG. 3, the ANC system 300 is configured to generate anti-noise to destructively interfere with undesired sound present in a target space 302. In one example, the ANC system 300 may be configured to be used in a vehicle to eliminate an undesired sound such as engine noise. However, various undesired sounds may be targeted for reduction or elimination such as road noise or any other undesired sound associated with a vehicle. Undesired sound may be detected through at least one sensor 304. In one example, the sensor 304 may be an accelerometer, which may generate an undesired sound signal 308 based on a current operating condition of a vehicle engine indicative of the level of the engine noise. Other manners of sound detection may be implemented, such as microphones or any other sensors suitable to detect audible sounds associated with the vehicle or other sound environment.

The undesired sound signal 308 may be produced by the sensor 304 as an analog signal. An analog-to-digital (A/D) converter 309 may digitize the undesired sound signal 308. The digitized signal 310 may be provided to a sample rate converter (SRC) 312. The SRC 312 may adjust the sample rate of the signal 310. In one example, the A/D converter 309 may be configured to generate a digitized sample rate of 192 kHz. The SRC 312 may reduce the sample rate from 192 kHz to 4 kHz. In alternative examples, the A/D converter 309 and the SRC 312 may be configured to generate signals of having various sample rates.

An output signal 314 of the SRC 312 represents the undesired sound and may be provided to an anti-noise generator 316 of the ANC system 300. The output signal 314 may also be provided to an estimated path filter 318. The estimated path filter 318 simulates the effect of traversing a physical path between the speaker 306 to a microphone 311. A filtered output signal 320 may be provided to the anti-noise generator 316. The output signal 314 and the filtered output signal 320 may be used by an adaptive filter 322 and LAU 324 of the anti-noise generator 316 in a manner similar to that described in regard to FIG. 2.

An audio system 326 may be implemented to generate speaker output intended to be heard within the target space 302. The audio system 326 may include a processor 327 and a memory 329. The memory 329 may be computer-readable storage media or memories, such as a cache, buffer, RAM, removable media, hard drive or other computer readable storage media. Computer readable storage media include various types of volatile and nonvolatile storage media. Various processing techniques may be implemented by the processor 327 such as multiprocessing, multitasking, parallel processing and the like, for example.

The audio system 326 may generate an audio output signal 328. In one example, the output signal 328 may be generated at a sample rate of 48 kHz. The audio output signal 328 may be provided to a SRC 330. The SRC 330 may be configured to increase the sample rate of the audio output signal 328. In one example, the SRC 330 may generate an output signal 332 at a sample rate of 192 kHz. The output signal 332 may be provided to a delay operator 334. The delay operator 334 delays the audio from being generated as a sound wave to coincide with the associated anti-noise generation processing. Output signal 336 of the delay operator 334 represents the audio output signal 328 at a converted sample rate.

As similarly described with regard to FIG. 2, anti-noise produced by the ANC system 300 may be adjusted based on a condition of the audio system 326. The anti-noise generator 316 may generate an anti-noise signal 338. The anti-noise signal 338 may be adjusted by an anti-noise signal compensator 340 to produce an adjusted anti-noise signal 342. The anti-noise signal 338 may be produced at a sample rate of 4 kHz. The adjusted anti-noise signal 342 may be provided to a SRC 344. The SRC 344 may be configured to increase the sample rate of the adjusted anti-noise signal 342. In one example, the SRC 344 may adjust the sample rate of the adjusted anti-noise signal 342 from 4 kHz to 192 kHz. The SRC 344 may produce an output signal 346, which may represent the adjusted anti-noise signal 342 at an increased sample rate.

In one example, the compensator 340 may adjust the anti-noise signal 338 based on the volume setting of the audio system 326. In FIG. 3, a volume signal 345 may indicate a volume setting of the audio system 326. A volume threshold detector 347 may receive the volume signal 345. The threshold detector 347 may provide a threshold indication signal 349 to the anti-noise signal compensator 340.

In FIG. 3, the threshold detector 347 may determine when the volume setting of the audio system 326 reaches a predetermined volume setting. The predetermined volume setting may represent a setting at which the volume of speaker output based on the audio system 326 masks at least a portion of the undesired sound in the target space 302. In FIG. 3, the threshold indication signal 349 may be provided to the compensator 340 to indicate that the anti-noise signal 338 may be adjusted. In FIG. 3, the compensator 340 may act as an on/off switch, such that none of the anti-noise signal 338 is used to generate anti-noise. When the volume setting is below the predetermined threshold, the threshold indication signal 349 may indicate such to the compensator 340, which will allow the entire anti-noise signal 338 to be used as the adjusted anti-noise signal 342.

In FIG. 3, the output signal 346 is shown as being summed with the signal 336 at summation operation 348. In one example, the signals 336, 346 may be summed together to form signal 350 as input for the speaker 306 to produce sound waves containing both audio content and anti-noise. In FIG. 3, the summed signal 350 is provided to a digital-to-analog converter 351 to generate an analog signal 352. The analog signal 352 drives the speaker 306 to produce a sound wave representative of the audio output signal 328 and the adjusted anti-noise signal 342. In alternative examples, signals based on output from the audio system 326 may be provided to speakers other than speaker 306 to produce sounds waves based on the output signal 328 of the audio system 326. In such alternative examples, the output signal 346 may be provided directly to the D/A converter 351 without use of the summation operation 348.

The sound waves generated by the speaker 306 may be projected towards the target space 302. The microphone 311 may be positioned within the target space 302. The microphone 311 may detect sound waves in the target space 302 resulting from the combination of anti-noise and undesired sound. The detected sound waves may cause the microphone 311 to generate a microphone output signal, which may be used as an error signal 356 indicating a difference between the anti-noise and undesired sound proximate to the microphone 311. The error signal 356 may be provided to an A/D converter 358. The A/D converter 358 may generate a digitized error signal 360. In one example, the A/D converter 358 may digitize the error signal 356 at a sample rate of 192 kHz. The error signal 360 may be provided to a SRC 362. The SRC 362 may be configured to reduce the sample rate of the error signal 356. The SRC 362 may produce an output signal 364 at a sample rate of 4 kHz. The output signal 364 may represent the error signal 360 at a reduced sample rate. The output signal 364 may be provided to an error compensator 366.

As similarly discussed with regard to FIG. 2, compensating the anti-noise signal 338 may cause a difference between the anti-noise that may be generated based on the anti-noise signal 338 and that generated based on the adjusted anti-noise signal 346. The error adjustment compensator 366 may adjust the output signal 364 to provide an adjusted error signal 368 to the anti-noise generator 316. The adjusted error signal 368 may represent a possible error signal arising from combining anti-noise based on the anti-noise signal 338 and the undesired sound in the target space 302. Thus, the anti-noise generator 316 may continue to generate the anti-noise signal 338 without being affected by the adjustment of the anti-noise signal 338. In FIG. 3, the error compensator 366 may receive the threshold indicator signal 349 causing the error compensation operator 366 and the adjustor 340 to operate in parallel, such that both are "on," which allows anti-noise to be produced based on the anti-noise signal 338 or "off", which may block any error signal from being received by the anti-noise generator 316.

Figure 4:
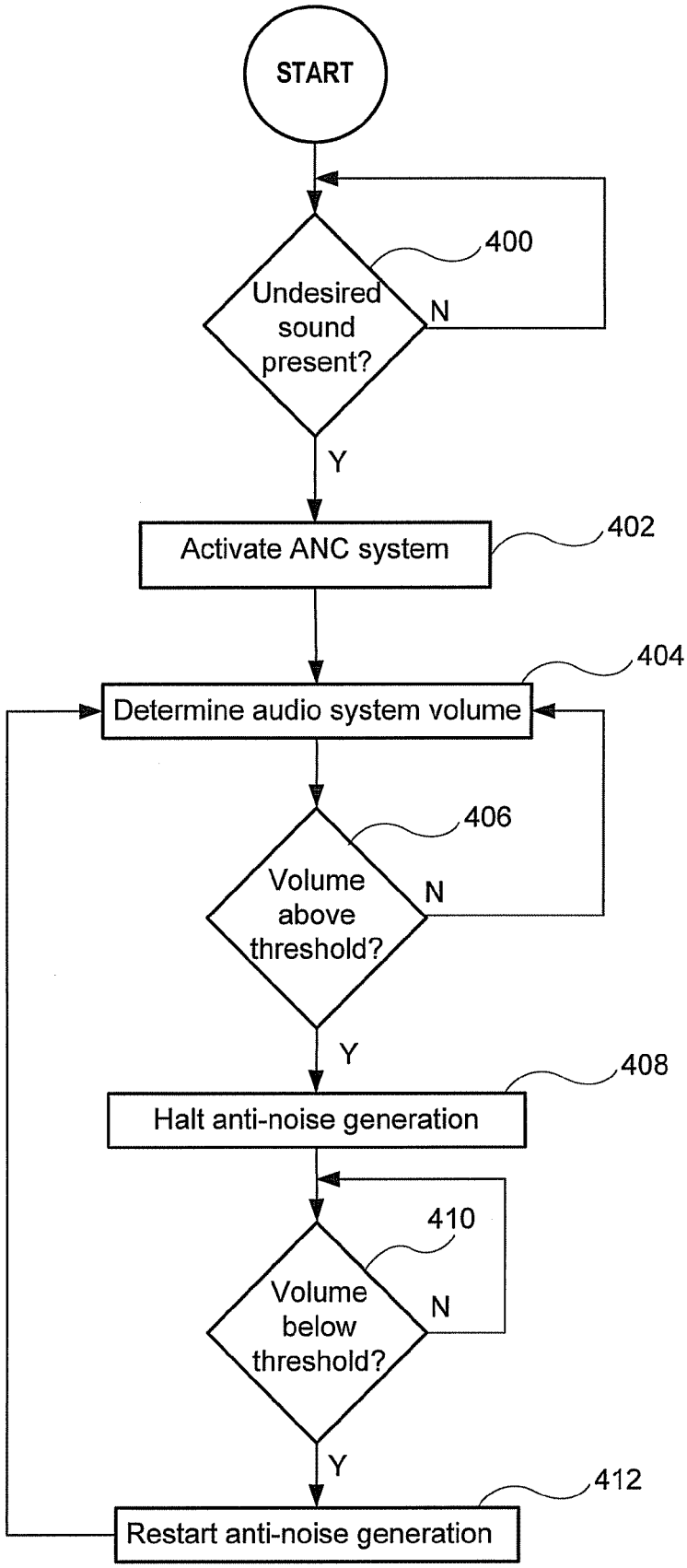
FIG. 4 is a flow diagram of an example operation of an ANC system configured to adjust anti-noise generation based on a volume setting of an audio system.

FIG. 4 is a flow diagram of an example operation of an ANC system, such as the ANC system 300 of FIG. 3. A step 400 may include determining if an undesired sound is present. In one example, the determination of the step 400 may represent an ANC system configured to operate upon presence of an undesired sound without an active decision required by the ANC system. If no undesired sound is present, step 400 may continuously be performed until the undesired sound is present. For example, the ANC system 300 begins generating anti-noise upon detection of the undesired sound through the sensor 304. If the undesired sound is present, a step 402 of activating an ANC system may be performed. The step 402 may include automatic production of anti-noise based on the presence of the undesired sound in a manner such as that described with regard to the ANC system 300. Upon activation of the ANC system, a step 404 may be performed of determining an audio system volume.

Upon determining the audio system volume, a step 406 of determining if the volume is above a predetermined threshold is performed. An audio system may produce an output signal indicative of the volume setting of the audio system. In one example, a volume threshold detector may be used, such as the volume threshold detector 347 in FIG. 3. The predetermined volume threshold may be selected for comparison to a current audio system volume setting. If a current volume setting is not above the predetermined volume threshold, the step 404 may be performed to determine the audio system volume. If the volume is determined to be above the predetermined volume threshold, a step 408 of halting anti-noise generation may be performed. In the ANC system 300, halting generation of anti-noise may occur through operating the compensator 340, which may attenuate the anti-noise signal 328 such that the anti-noise signal 328 does not reach any speaker for the generation of anti-noise.

The operation may include a step 410 of determining if the audio system volume is below the predetermined threshold. If the volume is below the predetermined threshold, the halting of anti-noise generation may be maintained. If the volume is determined to be below the predetermined threshold, the generation of the anti-noise may be restarted at a step 412. In one example, the step 412 may be performed in an ANC system such as the ANC system 300 by operating the anti-noise signal compensator 340 to allow the anti-noise signal 328 to drive the speaker 306 in order to generate anti-noise. The error compensator 366 may also be operated in steps 408 and 412 as described with regard to FIG. 3. Upon performance of the step 412, the step 404 may be performed of determining the audio system volume. The audio system volume may be continuously determined allowing the anti-noise to be halted and restarted based on the volume setting of the audio system.

Figure 5:
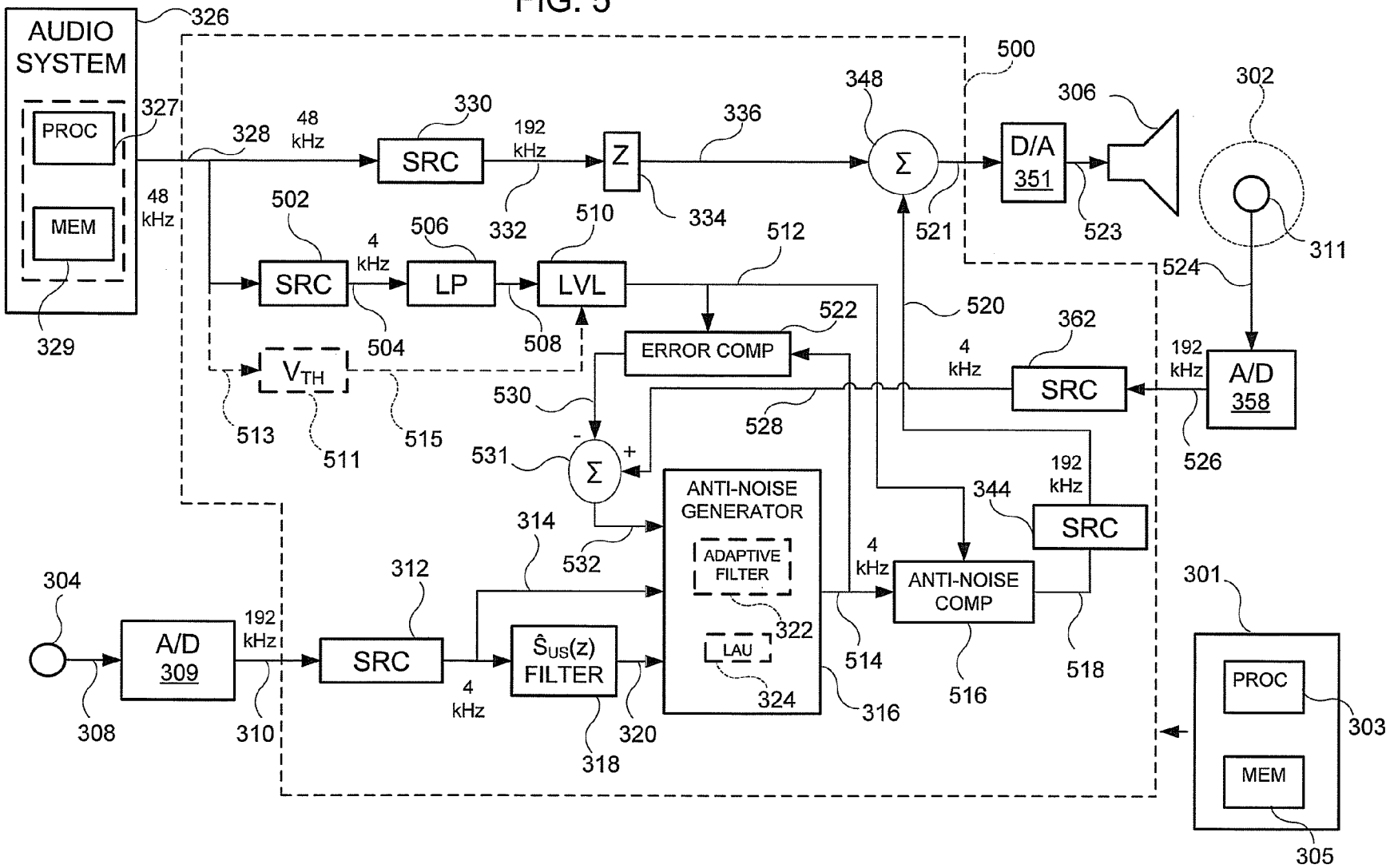
FIG. 5 is an example ANC system configured to adjust anti-noise generation based on power level of audio system output signals.

FIG. 5 shows an example ANC system 500 configured to adjust anti-noise generation based on a condition of the audio system 326. The ANC system 500 may be generated by the computer device 301 similar to that described with regard to the ANC system 300. In one example, the ANC system 500 may be configured to adjust anti-noise generation based on the power level of output signal components of the audio output signal 328. The ANC system 500 may adjust anti-noise generation based on audio system output signals having signal components within a predetermined frequency range. The ANC system 500 may be configured to implement components similar to those used in the ANC system 300. Like reference numbers may be used with regard to FIG. 5 to indicate such similarity.

Similar to that described in regard to FIG. 3, the audio system 326 generates an audio output signal 328, which may be processed to drive a speaker, such as the speaker 306. The audio output signal 328 may include various frequencies components. In one example, a particular frequency range of the audio output signal 328 may mask an undesired sound, as perceived by a listener, in the target space 302 when used to drive a speaker to provide sound waves to the target space 302. In one example, the ANC system 500 may be configured to generate anti-noise to destructively interfere with an undesired sound in a frequency range of 20-500 Hz.

The ANC system 500 may be configured to isolate the frequencies in the audio output signal 328 within the frequency range of the undesired noise and adjust anti-noise generation based on the presence of the isolated frequencies in the audio output signal 328. The ANC system 500 may be configured to adjust the generated anti-noise based on the power level of particular signal frequencies within the audio output signal 328. In one example, a SRC 502 may receive the audio output signal 328 to reduce the sample rate of the audio output signal 328. In the example of FIG. 5, the sample rate may be reduced from 48 kHz to 4 kHz. The output signal 504 of the SRC 502 may be provided to a low pass filter 506. The low pass filter 506 may filter the output signal 504 to isolate a desired frequency range of the output signal 504.

The output signal 508 of the low pass filter 506 may be analyzed to determine the power associated with frequencies within a predetermined frequency range. The power of the output signal 504 within particular frequency ranges may indicate the loudness of a particular frequency range in the target space 302 when used to drive a speaker to produce sound waves that may travel to the target space 302. A level detector 510 may receive the output signal 508 from the low pass filter 506. The level detector 510 may be configured to determine the power level associated with the signal frequencies passing through the low pass filter 506 and generating an output signal 512 indicative of the determined power level.

In one example, the level detector 510 may be a quasi-peak detector configured to determine when a signal is at a particular level for a predetermined amount of time. The level detector 510 may be configured to perform in a "catch-and-release" mode in which the level detector 510 may monitor the output signals over windows of time. The level detector 510 may monitor each window to determine the power level of the output signal 508 for a predetermined amount of time prior to monitoring the next window of time. The level detector 510 may generate an output signal 512 indicating the power level of the output signal 508.

The ANC system 500 may include the anti-noise generator 316, which receives the output signals 314 and 320 as input signals for use in generating the anti-noise signal 514. The anti-noise signal 514 may be adjusted based on the power output signal 512. An anti-noise signal compensator 516 may receive the anti-noise signal 514. The compensator 516 may receive the anti-noise signal 514 and adjust the anti-noise signal 514 based on the output of the detector 510 to generate an adjusted anti-noise signal 518. The adjusted anti-noise signal 518 may be received by the SRC 344 to increase the sample rate to 192 kHz and generate an output signal 520, which may be combined with output signal 350 to form signal 521. The signal 521 may be provided to the D/A converter 351 to produce an analog signal 523 to drive the speaker 306 to generate anti-noise into the target space 302. In alternative examples, the output signal 350 may be used to drive speakers other than the speaker 306, which may allow the output signal 520 to be provided directly to the D/A converter 351.

The compensator 516 may be configured to vary adjustment of the anti-noise signal 514 based on the output signal 512. In one example, the output signal 512 is indicative of the power level of the output signal 508. The compensator 516 may be configured similar to the compensator 222 of FIG. 2 allowing the amplitude of the anti-noise signal to be reduced based on the output signal 512. As the power associated with the signal 508 increases, the anti-noise may be further reduced. Thus, the output signal 512 may be used as a control signal to adjust the gain of the compensator 516.

A volume threshold detector 511 may be used in manner similar to the voltage threshold detector 347. The volume threshold detector 511 may receive a volume signal 513 indicating the volume of the audio system 326. The volume threshold detector 511 may generate a volume threshold signal 515 indicative of the volume setting of the audio system 326. The volume threshold signal 515 may be provided to the level detector 510. If the volume setting of the audio system 326 is below a predetermined volume threshold, the level detector 510 determine that the anti-noise signal 514 should not be adjusted because the volume of the audio system is low enough that it would not mask the undesired sound in the target space 302. If the volume is above the predetermined threshold, the level detector 510 may provide the signal 512 for anti-noise signal adjustment.

An error compensator 522 may be configured to adjust an error signal to compensate for the adjustment of the anti-noise signal 514. As previously discussed, adjustment of the anti-noise downstream of the anti-noise generator 316 may cause an error signal to be detected by the microphone 311 that would cause the anti-noise generator 316 to generate an undesired anti-noise signal 514. Thus, the error signal may be adjusted accordingly. In FIG. 5, sound detected by the microphone 311 in the target space 302 may result in a microphone output signal 524 being generated. The output signal 524 may be digitized by A/D converter 358 to produce a digitized error signal 526. The error signal 526 may be provided to SRC 362 to decrease the sample rate. The SRC 362 may generate an output signal 528. In FIG. 5, the SRC 362 decreases the sample rate of the error signal 526 from 192 kHz to 4 kHz.

The anti-noise signal 514 may be provided to the error compensator 522. In one example, the error compensator 522 may be configured similar to the error compensator 228 of FIG. 2. The gain of the error compensator 522 may be adjusted based on the output signal 512 to one minus the gain of the anti-noise signal compensator 516. The error compensator 522 may further process the anti-noise signal 514 to generate an error compensation signal 530, which may be removed from the output signal 528 at operator 531 to generate an adjusted error signal 532. The adjusted error signal 532 may be provided to the anti-noise generator 316 to be used in generating the anti-noise signal 514.

Figure 6:
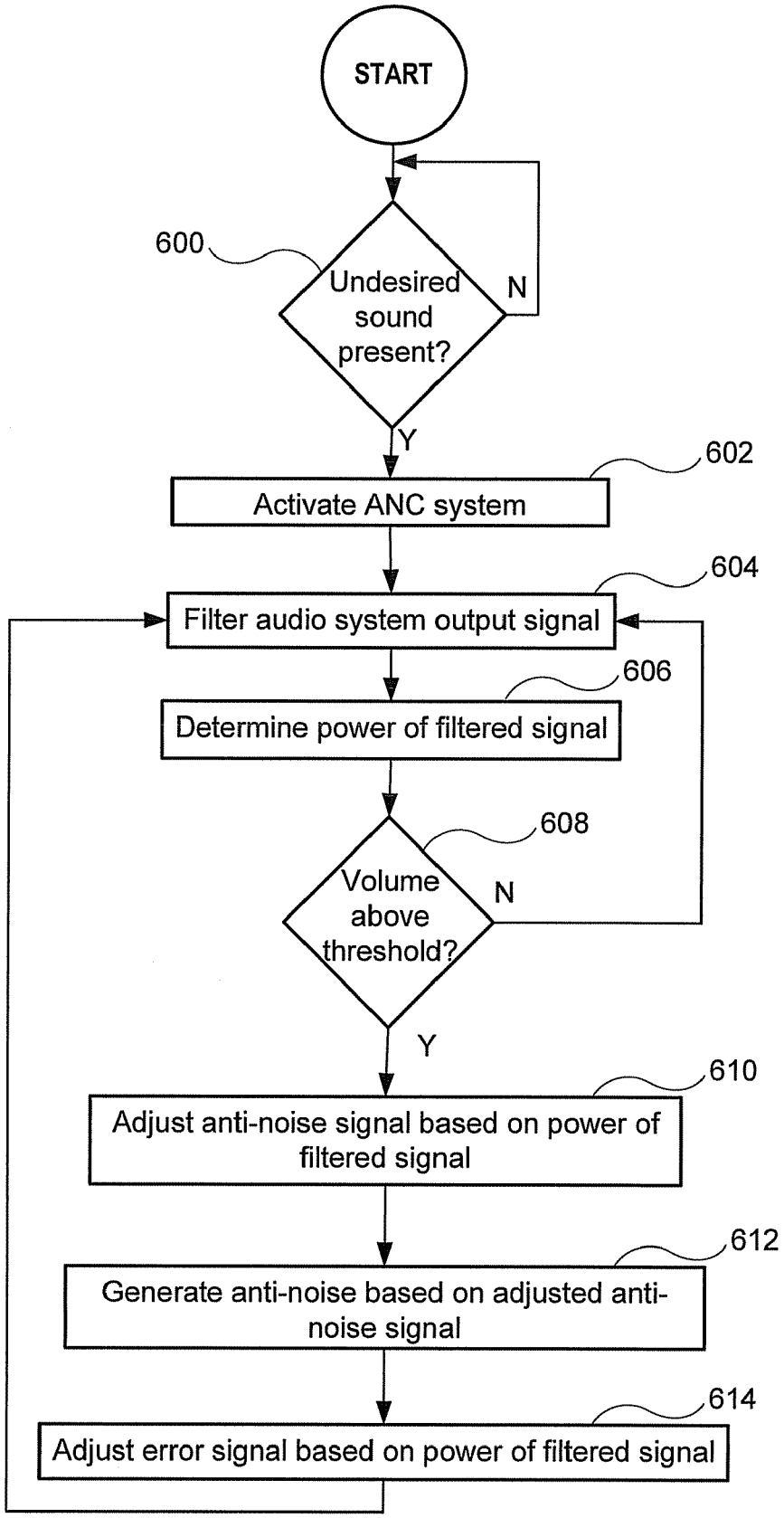
FIG. 6 is a flow diagram of an example operation of an ANC system configured to adjust anti-noise generation based on power level of audio system output signals.

FIG. 6 is a flow diagram of an example operation of an ANC system configured to adjust anti-noise generation based on the power of an audio output signal of an audio system. The operation may include a step 600 of determining if an undesired sound is present. Similar to the operation of FIG. 4, the step 600 may be performed passively through a sensor, such as the sensor 304. If an undesired sound is present, the operation may include a step 602 of activating the ANC system to generate anti-noise, which may occur automatically upon the presence of a targeted undesired sound.

The operation may include a step 604 of filtering an audio system output signal, such as the audio output signal 326. In one example, the audio output signal 326 may be filtered by the low pass filter 506. The operation may include a step 606 of determining the power of the filtered signal. In one example, a level detector 510 may receive the filtered output signal 508 and determine the power, or amplitude, of the filtered output signal. The level detector 510 may be configured to generate an output signal 512 indicative of the power associated with the filtered output signal 508 for a particular window of time. The signal 512 may vary as the power of the output signal 508 varies.

The operation may include a step 608 of determining if the volume of the audio system is above a predetermined threshold. As described in regard to FIGS. 3-5, volume setting of the audio system 326 may be monitored. Prior to reaching a predetermined volume setting, the volume setting may be so low that audio speaker output based on the audio system 326 may not be loud enough to mask an undesired sound in the target space 302. Thus, until the predetermined threshold is reached by the volume setting, the anti-noise generator 316 may continue to generate the anti-noise signal 514 without adjustment. If the volume setting is above the predetermined threshold, a step 610 of adjusting the anti-noise signal based on the power of the filtered audio output signal may be performed. In one example, step 610 may be performed by the anti-noise compensator 516. The anti-noise compensator 516 may reduce the amplitude of the anti-noise signal 514 based on the signal 512. As the power of the output signal 508 increases, the signal 512 indicates the compensator 516 may further reduce the anti-noise signal 514 amplitude.

The operation may further include a step 612 of generating anti-noise based on the adjusted anti-noise signal. In the ANC system 500, the adjusted anti-noise signal 518 may be generated by the compensator 516. The adjusted anti-noise signal 518 may be used to drive the speaker 306 to generate sound waves containing anti-noise. The operation may further include a step 614 of adjusting an error signal based on the power of the filtered signal. The error signal may be adjusted to compensate for the anti-noise signal being adjusted. In one example, an error compensation signal may be generated based the power of the filtered signal. For example, the ANC system 500 includes an error compensator 522 configured to receive the level detector output signal 512 and the anti-noise signal 514. The error compensator 522 may generate an error compensation signal 530, which may be subtracted from the error signal 528 to form the adjusted error signal 532 for use by the anti-noise generator 316. Upon adjustment of the error signal, the operation may perform step 604 to continue operation of the ANC system.

Figure 7:
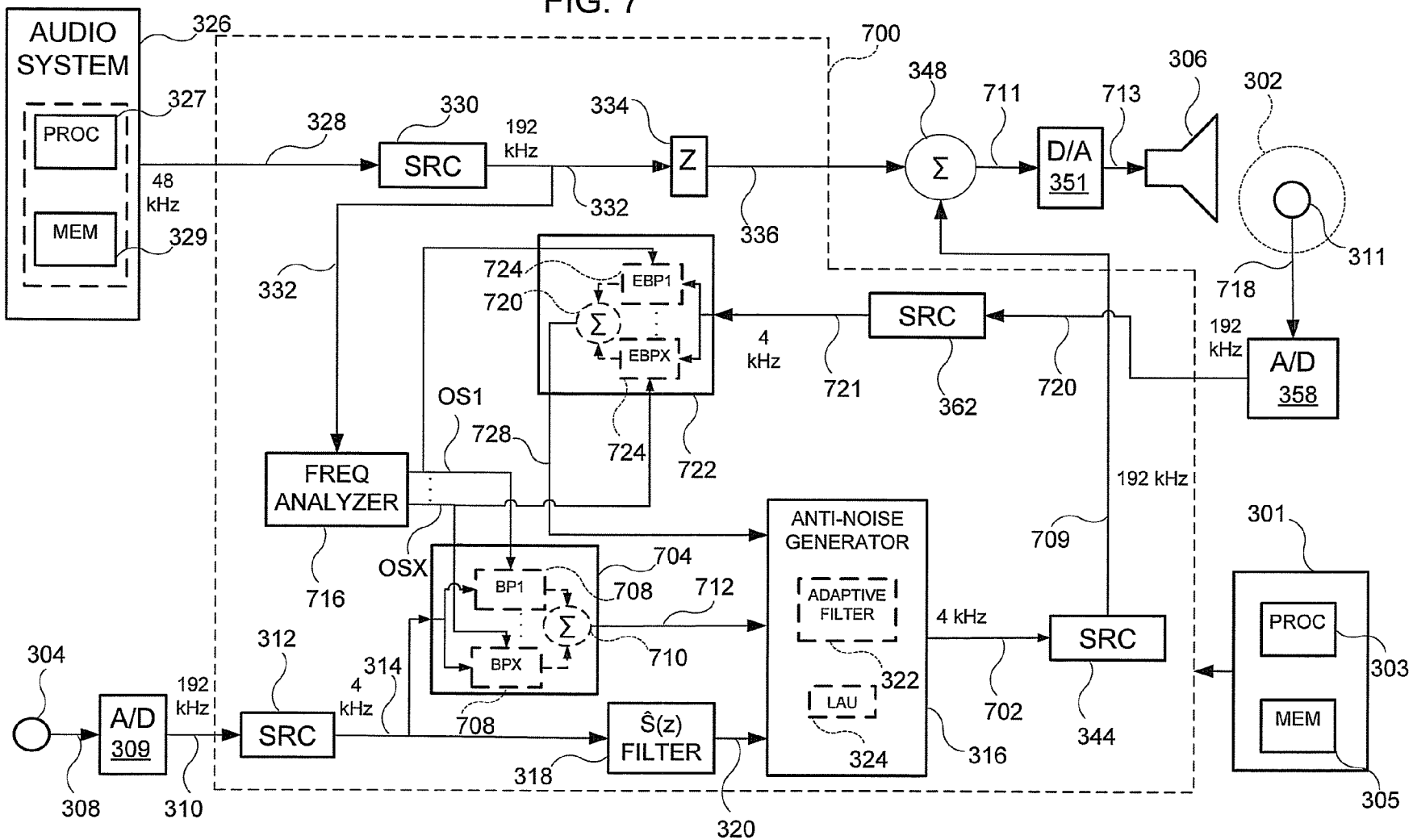
FIG. 7 is an example ANC system configured to adjust anti-noise generation based on presence of predetermined frequencies in audio output signals.

FIG. 7 shows an example ANC system 700 configured to adjust anti-noise generation based on output from the audio system 326. In FIG. 7, the ANC system 700 is configured to process signals similar to those discussed with regard to FIGS. 3 and 5. Same reference numbers may be used to refer to the similar signals. The ANC system 700 may be generated by the computer device 301.

The ANC system 700 is configured to adjust anti-noise generation of the anti-noise generator 316 such that particular frequencies and frequency ranges of anti-noise may be reduced based on the audio output signal 328. In one example, speaker output based on the audio signal 328 may mask an undesired sound in the target space 302. The ANC system 700 may be configured to determine particular frequencies present in the audio signal 328 that may mask at least some of the undesired sound. The anti-noise signal 702 may be adjusted such that the masking frequencies present in the audio output signal 328 may be reduced or eliminated from the generated anti-noise.

Particular frequencies present in an audio signal 328 may be reduced or eliminated from the undesired sound signal 314 before reach may be reduced or eliminated prior to the anti-noise signal 702 being used to generate anti-noise. The undesired sound signal 314 may be provided to an anti-noise signal compensator 704 in order to generate adjusted the anti-noise signal 702. The anti-noise compensator 704 may include a plurality of bandpass filters 708, individually designated as BP1 through BPX in FIG. 7. The bandpass filters 708 may each be configured for a particular frequency range different from one another. Thus, as the undesired sound signal 314 is provided to the compensator 704, each bandpass filter 708 will allow a particular frequency range to pass when present in the anti-noise signal 702.

Each of the bandpass filters 708 may have an adjustable gain allowing each filter to reduce or eliminate a particular range of signal frequencies present in the undesired noise signal 314. Signals passing through the bandpass filters 708 may be summed at summation operation 710 to form an adjusted input signal 712. The adjusted input signal 712 may be used to generate anti-noise configured to eliminate undesired sounds that may not be masked by the audio-based sound waves.

Adjusting the gain of the bandpass filters 708 allows selected frequency signal components present in the undesired sound signal 314 to be reduced in amplitude when audio being played in the target space 302 contains sound that masks the selected frequency components. The gain of the bandpass filters 708 may be adjusted based on the frequency content of the audio output signal 328.

The output signal 332 may be provided to a frequency analyzer 716. The frequency analyzer 716 may analyze the audio output signal 332 to determine various signal frequencies present in the audio output signal 328. The frequency analyzer 716 may generate a plurality of output signals, with each output signal OS1 through OSX corresponding to one of the bandpass filters 708. The frequency analyzer 716 may determine the frequency content of the output signal 332, as well as the intensity level of the signal frequency components. The output signals OS1 through OSX may each be used as a control signal to adjust the gain of the corresponding bandpass filter 708. Thus, if a particular frequency or frequency range is determined to have a high enough intensity to mask at least a portion of an undesired sound, the bandpass filter 708 corresponding to the particular frequency or frequency range may be reduced in order to reduce the particular frequency or frequency range component amplitude of the signal 314, and consequently, the anti-noise signal 702. In one example, the ANC system 700 may include a volume threshold detector (not shown), such as the volume threshold detector 347. The volume threshold detector 347 may provide a signal to the frequency analyzer 716 indicated the volume is above predetermined threshold such that the audio is loud enough that adjustment of the anti-noise is desired.

In one example, the frequency analyzer 716 may be configured to perform a spectral analysis of the output signal 332. The frequency analyzer 716 may be configured to gather blocks of samples of the output signal 332 to perform a fast Fourier transform (FFT) of the block of samples of the output signal 714. Performing the FFT allows a number of frequency bands to be established and each sample analyzed by the frequency analyzer 716 may be associated with one of the frequency bands. The number of samples selected for each analyzed block may be determined by the sample rate of the signal 332. In FIG. 7, the sample rate of the output signal 332 is 192 kHz. Allowing a block of 128 samples would allow a bandwidth from 0 to approximately 750 Hz of undesired sound to be targeted by the ANC system 700. In one example, a plurality of sample blocks may be provided to the frequency analyzer 716 prior to the output signals OS1 through OSX being generated. The frequency analyzer 716 may determine averages over the plurality of blocks to determine if particular frequencies will remain for a particular duration of time or are transient in nature. The frequency analyzer 716 may not produce an output signal for a frequency determined to be transient in nature.

The number of samples associated with each frequency band provides the amplitude for a particular frequency band. Thus, each frequency band of the frequency analyzer 716 may be used to generate a respective output signal OS1 through OSX. The frequency analyzer 716 may include a predetermined threshold associated with each frequency band, such that no output signal will be generated from the frequency analyzer 716 unless the amplitude for a particular frequency band is above the predetermined threshold. Each frequency band of the frequency analyzer 716 may correspond to one of the bandpass filters 704.

The anti-noise signal 702 may be provide to SRC 344 which may increase the sample rate of anti-noise signal 702 and generate an output signal 709. In FIG. 7, the sample rate of the anti-noise signal 702 may be increased from 4 kHz to 192 kHz. In FIG. 7, the adjusted anti-noise signal 709 may be combined with the output signal 336 to form the output signal 711. The output signal 711 may be provided to the D/A converter 351, which may generate an analog signal 713 to drive the speaker 306 to generate anti-noise, as well as audio, into the target space 302.

The microphone 311 may detect sound waves resulting from anti-noise destructively interfering with undesired sound in the target space 302. If the anti-noise signal 702 is adjusted through the compensator 704, more error may result because the anti-noise has been reduced due to the presence of audio having masking frequencies. While a listener may not hear the undesired sound due to masking, the microphone may detect the undesired sound not destructively interfered with due to adjustment of the anti-noise signal 708. A microphone output signal 718 may be digitized by the A/D converter 358 and used as an error signal 720. The error signal 720 may be provided to the SRC 362 to decrease the sample rate, similar to that described in FIG. 5. The SRC 362 may generate an output signal 721, which is a decreased sample rate version of the error signal 720.

The output signal 721 may be adjusted to compensate for the adjustment of the anti-noise signal by the compensator 704. The signal 721 may be provided to an error compensator 722. The error compensator 722 may include a plurality of bandpass filters 724, individually designated as EBP1 through EBPX. Each bandpass filter 724 is configured to have a passband corresponding to those of the bandpass filters 708. The signal 721 may be broken into frequency bands by the bandpass filters 724. Each of the bandpass filters 724 may have an adjustable gain. Each bandpass filter 724 may be adjusted based on the corresponding output signal OS1 through OSX. Each output signal OS1 through OSX may be used to adjust the gain to reduce the frequencies present in the error signal 320 that were reduced or eliminated from the undesired sound signal 314. The output signals of each bandpass filter 724 may be summed at summation operation 726 to form a compensated error signal 728. The compensated error signal 728 may be provided to the anti-noise generator 316.

Figure 8:
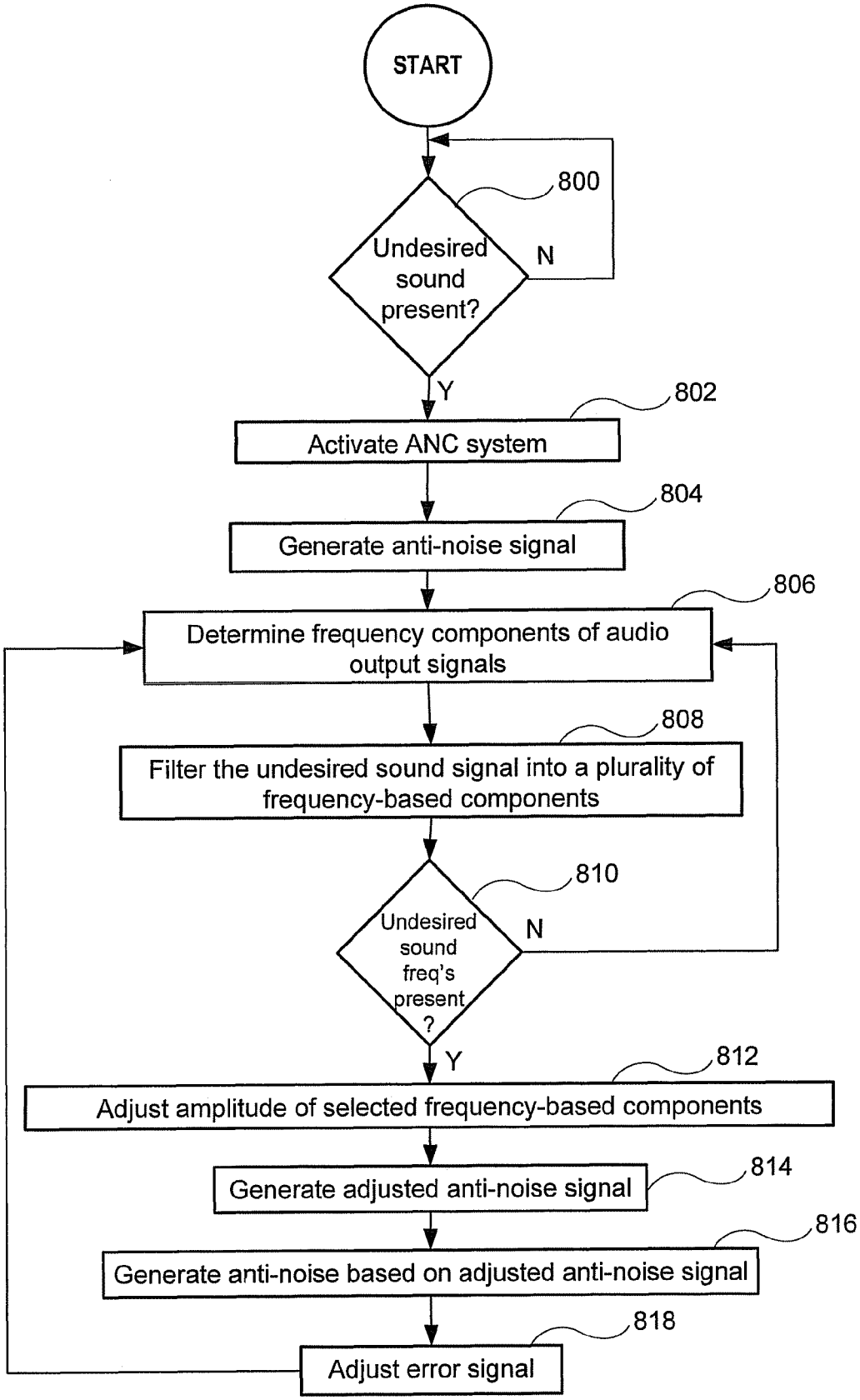
FIG. 8 is a flow diagram of an example ANC system configured to adjust anti-noise generation based on presence of predetermined frequencies in audio output signals.

FIG. 8 is a flow diagram of an example operation of an ANC system configured to adjusted generated anti-noise based on particular frequencies present in an output signal of an audio system. The operation may include a step 800 of determining if an undesired sound is present. Similar to the operations of FIGS. 4 and 6, step 800 may be passively performed through a sensor, such as the sensor 304. If the undesired sound is not detected, step 800 may be continuously performed until the undesired sound is present. Upon presence of the undesired sound, the operation may perform a step 802 of activating an ANC system, such as the ANC system 700.

The operation may include a step 804 of generating an anti-noise signal based on the undesired sound, such as through the anti-noise generator 316. The operation may include a step 806 of determining frequency components of audio output signals. In one example, the ANC system 700 may include a frequency analyzer 716, which includes output signal 714, which is the audio output signal 328 at a reduced sample rate. The frequency analyzer 716 may be configured to determine frequency components of output signal 714, such as particular frequency ranges.

The operation may include a step 808 of filtering an undesired sound signal into a plurality of frequency-based components. The undesired sound signal may be provided to a plurality of adjustable gain filters to break the undesired sound signal into various frequency range components, such as the bandpass filters 708 of FIG. 7.

The operation may include a step 810 of determining if undesired sound frequencies are present in the audio output signal. In one example, the frequency analyzer may be configured to determine if particular frequency ranges are present in within an encompassing frequency range such as 20-500 Hz. If none of the undesired sound frequencies are present in the audio output signal, step 806 may be performed. If undesired sound frequency components are present, a step 812 of adjusting amplitude of selected frequency-based undesired sound components. In one example, an undesired sound signal, such as the undesired sound signal 314 may be provided to a plurality of bandpass filters 708. The bandpass filters 708 may each be configured to allow a particular frequency range to pass through. Each bandpass filter 708 may be configured to adjust the amplitude of the signals passed through. The amplitude adjustment may be performed based on the frequency components present in the audio output signal 332 as determined by the frequency analyzer 716.

The operation may include a step 814 of generating an adjusted anti-noise signal. In one example, the adjusted anti-noise signal may be generated based on an adjusted undesired sound signal. The adjusted undesired sound signal may be generated by an anti-noise signal compensator, such as the compensator 704. The compensator 704 may provide an adjusted input signal 712. Each bandpass filter 708 may receive a gain adjustment signal from the frequency analyzer 716. The operation may further include a step 816 of generating anti-noise based on the anti-noise signal.

The operation may further include a step 818 of adjusting an error signal. As previously described, an error signal provided to the anti-noise generator 316 may be adjusted to compensate for the adjustment of the anti-noise signal 702. In the ANC system 700, the output signal 721 representative of the error may be adjusted. In the ANC system 700, the error signal 720 may be provided to an error compensator 722, which may include a plurality of bandpass filters 724 to receive the anti-noise signal 702. Each bandpass filter 724 may receive a signal from frequency analyzer 716 that adjusts gain of a respective filter 724 based on a respective signal OS1 through OSX. Each bandpass filter 724 corresponds to one of the bandpass filters 708. The outputs of each filter 724 are summed at summation operation 726 in FIG. 7, for example. The output of the summation operation 728 is a compensated error signal 728, which is provided to the anti-noise generator 316. The compensated error signal 728 may be provide to the anti-noise generator 316 to be used by the LAU 324 in manner similar to that described with regard to FIG. 2. Upon adjustment of the error signal, step 806 may be performed.

While various embodiments of the invention have been described, it will be apparent to those of ordinary skill in the art that many more embodiments and implementations are possible within the scope of the invention. Accordingly, the invention is not to be restricted except in light of the attached claims and their equivalents.

We claim:

1. A sound reduction system comprising:

a processor; and an active noise control system executable by the processor, the active noise control system configured to:

receive a first input signal representative of sound present in a predetermined area;

receive as a second input signal an output signal generated by an audio system communicatively coupled with the sound reduction system, the audio system configured to drive a loudspeaker to produce a desired sound in the predetermined area;

generate an anti-noise signal based on the first input signal; and adjust the anti-noise signal based on the second input signal;

where, the anti-noise signal is configured to drive a loudspeaker to produce an audible sound to destructively interfere with an undesired sound present in the predetermined area.

2. The system of claim 1, where the second input signal is representative of the volume setting of the audio system; and where, the active noise control system is further configured reduce the amplitude of the anti-noise signal when the volume setting is above a predetermined threshold.

3. The system of claim 2, where the active noise control is further configured to halt production of the anti-noise when the volume setting is above the predetermined threshold.

4. The system of claim 1, where the active noise control system includes a signal level detector;

where the signal level detector is configured to determine the power level of a predetermined frequency range of the second input signal and generate a third input signal representative of the power level of the predetermined frequency range of the second input signal; and where the anti-noise signal is adjusted based on the third input signal.

5. The system of claim 4, where the active noise control system includes an anti-noise signal compensator configured to adjust the anti-noise signal based on the third input signal.

6. The system of claim 5, where the anti-noise signal compensator is configured to reduce the amplitude of the anti-noise signal based on third input signal.

7. The system of claim 4, where the active noise control system is further configured to receive an error signal and adjust the anti-noise signal based on the error signal; and where the active noise control system includes an error compensator configured to adjust the error signal based on the third input signal.

8. The system of claim 7, where the error compensator is configured to generate an error compensation signal based on the third input signal and the anti-noise signal; and where the error compensation signal is subtracted from the error signal to adjust the error signal.

9. The system of claim 1, where the active noise control system includes a frequency analyzer configured to determine at least one signal frequency component present in the second input signal and generate a third input signal indicating the presence of the at least one signal frequency component, where the active noise control system is configured to adjust the anti-noise signal based on the third input signal.

10. The system of claim 9, where the active noise control system includes an anti-noise signal compensator having a plurality of filters, where each filter is associated with a respective frequency range and is configured to receive the first input signal; and where the frequency analyzer is configured to determine a plurality of frequency components present in the second input signal and generate a respective output signal indicating the presence of a corresponding frequency component in the second input signal;

where each respective output signal is associated with one of the plurality of filters; and where each respective output signal is configured to adjust a gain of each associated filter.

11. The system of claim 10, where the second input signal includes a plurality of samples, where the frequency analyzer is configured to receive the plurality of samples to determine the frequency components present in the second input signal.

12. The system of claim 10, where each filter is configured to generate a filter output signal;

where the filter output signals are summed to form an adjusted input signal; and where, the anti-noise signal is adjusted based on the adjusted input signal.

13. The system of claim 1, where the active noise control system is further configured to receive an error signal and adjust the anti-noise signal based on the error signal;

where the active noise control system includes an error compensator configured to adjust the error signal, where the error compensator includes a plurality of error compensation filters each configured to receive the error signal and generate a respective output signal, where the respective output signals are summed to generate an adjusted error signal; and where the anti-noise signal is adjusted based on the adjusted error signal.

14. A method of reducing volume of an undesired sound present in a space comprising:

generating a first input signal representative of the undesired sound present in a predetermined area;

receiving as a second input signal an output signal produced by an audio system, the audio system configured to drive a loudspeaker to produce desired sound in the space;

generating an anti-noise signal based on the first input signal;

adjusting the anti-noise signal based on the second input signal; and producing an audible sound based on the anti-noise signal to destructively interfere with the undesired sound present in the space.

15. The method of claim 14, where the second input signal is representative of a volume setting of the audio system, and where adjusting the anti-noise signal comprises reducing the amplitude of the anti-noise signal when the volume setting is above a predetermined threshold.

16. The method of claim 15 further comprising halting production of the audible sound when the volume setting is above a predetermined threshold.

17. The method of claim 14 further comprising determining the power level of a predetermined frequency range of the second input signal; and generating a third input signal representative of the power level of the predetermined frequency range of the second input signal, where adjusting the anti-noise comprises adjusting the anti-noise signal based on the third input signal.

18. The method of claim 17, where adjusting the anti-noise signal based on the third input signal comprises reducing the amplitude of the anti-noise signal based on the third input signal.

19. The method of claim 17 further comprising:

receiving an error signal; and adjusting the error signal based on the third input signal, where adjusting the anti-noise signal comprises adjusting the anti-noise signal based on the error signal.

20. The method of claim 19 further comprising generating an error compensation signal based on the third input signal, where adjusting the error signal comprises subtracting the error compensation signal from the error signal.

21. The method of claim 14, further comprising:

determining at least one signal frequency component present in the second input signal; and generating a third input signal indicating the presence of the at least one signal frequency component, where, adjusting the anti-noise signal comprises adjusting the anti-noise signal based on the third input signal.

22. The method of claim 21, further comprising:

providing the first input signal to a plurality of filters, where each filter is associated with a respective frequency range;

determining a plurality of frequency components present in the second input signal;

generating a respective output signal indicating presence of a corresponding frequency component in the second input signal, where each respective output signal is associated with one of the plurality of filters and where each respective output signal is configured to adjust the gain of the associated filter; and providing each of the plurality of filters with the associated respective output signal.

23. The method of claim 22 further comprising:

receiving a plurality of samples of the second input signal; and determining the frequency components present in the second input signal based on the plurality of samples.

24. The method of claim 22 further comprising:

generating a filter output signal with each of the plurality of filters;

summing the filter outputs to form an adjusted input signal; and adjusting the anti-noise signal based on the adjusted input signal.

25. A computer-readable medium encoded with computer executable instructions, the computer executable instructions executable with a processor, the computer-readable medium comprising:

instructions executable to generate a first input signal representative of an undesired sound present in a predetermined area;

instructions executable to receive as a second input signal an output signal produced by an audio system, the audio system configured to drive a loudspeaker to produce desired sound in the predetermined area;

instructions executable to generate an anti-noise signal based on the first input signal;

instructions executable to adjust the anti-noise signal based on the second input signal; and instructions executable to produce an audible sound based on the anti-noise signal to destructively interfere with the undesired sound present in a space the predetermined area.

26. The computer-readable medium of claim 25, where the instructions executable to receive a second input signal comprise instruction executable to receive the second input signal representative of a volume setting of the audio system; and where the instructions executable to adjusting the anti-noise signal comprise instructions to reduce the amplitude of the anti-noise signal when the volume setting is above a predetermined threshold.

27. The computer-readable medium of claim 25 further comprising instructions executable to halt production of the audible sound when the volume setting is above a predetermined threshold.

28. The computer-readable medium of claim 25 further comprising instructions executable to:

determine the power level of a predetermined frequency range of the second input signal; and generate a third input signal representative of the power level of the predetermined frequency range of the second input signal, where the instructions executable to adjust the anti-noise comprise instructions executable to adjust the anti-noise signal based on the third input signal.

29. The computer-readable medium of claim 28, where the instruction executable to adjust the anti-noise signal based on the third input signal comprise instructions executable to reduce the amplitude of the anti-noise signal based on the third input signal.

30. The computer-readable medium of claim 28 further comprising:

instructions executable to receive an error signal; and instructions executable to adjust the error signal based on the third input signal, where the instructions executable adjust the anti-noise signal comprise instruction executable to adjust the anti-noise signal based on the error signal.

31. The computer-readable medium of claim 30 further comprising instructions executable to generate an error compensation signal based on the third input signal, where the instructions executable to adjust the error signal comprise instructions executable to subtract the error compensation signal from the error signal.

32. The computer-readable medium of claim 25 further comprising:

instructions executable to determine at least one signal frequency component present in the second input signal; and instructions executable to generate a third input signal indicating the presence of the at least one signal frequency component, where, the instructions executable to adjust the anti-noise signal comprises instructions executable to adjust the anti-noise signal based on the third input signal.

33. The computer-readable medium of claim 32, further comprising:

instructions executable to provide the first input signal to a plurality of filters, where each filter is associated with a respective frequency range;

instructions executable to determine a plurality of frequency components present in the second input signal;

instructions executable to generate a respective output signal indicating presence of a corresponding frequency component in the second input signal, where each respective output signal is associated with one of the plurality of filters and where each respective output signal is configured to adjust the gain of the associated filter; and instructions executable to provide each of the plurality of filters with the associated respective output signal.

34. The computer-readable medium of claim 33 further comprising:

instructions executable to receive a plurality of samples of the second input signal; and instructions executable to determine the frequency components present in the second input signal based on the plurality of samples.

35. The computer-readable medium of claim 33 further comprising:

instructions executable to generate a filter output signal with each of the plurality of filters;

instructions executable to sum the filter outputs to form an adjusted input signal; and instructions executable to adjust the anti-noise signal based on the adjusted input signal.

36. The system of claim 1, where the output signal generated by the audio system is indicative of only a particular condition of the audio system.

37. The system of claim 1, where the output signal generated by the audio system is representative of either an audio output signal used to drive the loudspeaker, or a volume setting of the audio system.

* * * * *

UNITED STATES PATENT AND TRADEMARK OFFICE

CERTIFICATE OF CORRECTION

PATENT NO. : 8,189,799 B2
APPLICATION NO. : 12/421459
DATED : May 29, 2012
INVENTOR(S) : Vasant Shridhar et al.

It is certified that error appears in the above-identified patent and that said Letters Patent is hereby corrected as shown below:

On the Title Page Item (57)

Please insert --on-- after "based".

In the Claims

Column 15, Line 66, please insert --to-- before "reduce".

Column 18, Line 35, please delete "a space" after --in--.

Signed and Sealed this
Fourteenth Day of August, 2012

David J. Kappos

David J. Kappos
*Director of the United States Patent and Trademark Office*